US007090328B2

(12) United States Patent
Choi

(10) Patent No.: US 7,090,328 B2
(45) Date of Patent: Aug. 15, 2006

(54) WET-TYPE WIPING APPARATUS OF INKJET PRINTER AND MAINTENANCE APPARATUS HAVING THE SAME

(75) Inventor: Kyung-chool Choi, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 10/682,493

(22) Filed: Oct. 10, 2003

(65) Prior Publication Data

US 2004/0145623 A1 Jul. 29, 2004

(30) Foreign Application Priority Data

Jan. 23, 2003 (KR) ..... 10-2003-0004625

(51) Int. Cl.
*B41L 2/165* (2006.01)

(52) U.S. Cl. ..... 347/33; 347/36; 347/32

(58) Field of Classification Search ..... 347/22, 347/24, 28–30, 32, 33; 15/250, 361, 256.5
See application file for complete search history.

(56) References Cited

U.S. PATENT DOCUMENTS 5,555,461 A * 9/1996 Ackerman ..... 347/33
5,793,390 A * 8/1998 Claflin et al. ..... 347/33

* cited by examiner

*Primary Examiner*—Shih-Wen Hsieh
(74) *Attorney, Agent, or Firm*—Staas & Halsey LLP

(57) ABSTRACT

A wet-type wiping apparatus of an inkjet printer to clean a print head of the inkjet printer includes a moisture storing portion, a moisture suction portion disposed on an upper side of the moisture storing portion and having a plurality of moisture suction holes, and a wiper portion inserted in the moisture storing portion and having a plurality of capillary tubes vertically penetrating therein. The moisture suction portion includes one of calcium chloride, a silica gel, and a high molecular weight substance, which are highly absorbent. The moisture storing portion includes a foam for containing moisture therein.

14 Claims, 3 Drawing Sheets

WET-TYPE WIPING APPARATUS OF INKJET PRINTER AND MAINTENANCE APPARATUS HAVING THE SAME

CROSS-REFERENCE TO RELATED APPLICATIONS

This application claims the benefit of Korean Application No. 2003-4625, filed Jan. 23, 2003, in the Korean Intellectual Property Office, the disclosure of which is incorporated herein by reference.

BACKGROUND OF THE INVENTION

1. Field of the Invention

The present invention relates to an inkjet printer, and more particularly, to a wet-type wiping apparatus which is capable of effectively cleaning an inkjet print head, and a maintenance apparatus having the same.

2. Description of the Related Art

Generally, an inkjet printer prints an image by attaching droplets of ink created by heating the ink stored in a cartridge onto a paper sheet through nozzles, and comprises a wiping apparatus for preventing ink residue from being adhered to an ink head and the print quality from being deteriorated in the next printing.

A conventional wiping apparatus and a maintenance apparatus having the same are described below referring to FIGS. 1 and 2.

Inside the printer body 10, a carriage 20 with an ink cartridge 21 mounted thereon is disposed to move left and right. The movement area of the carriage 20 is divided into a print area P in which ink is sprayed through a nozzle portion 21*a* of the ink cartridge 21, and a service area S in which the carriage 20 is parked 30 or ink at the nozzle portion 21*a* is cleaned. A maintenance apparatus is disposed at one side of the service area S.

The ink cartridge 21 disposed in the carriage 20 sprays ink as it moves left and right in the print area P. When the printing is completed, the ink cartridge 21 moves into the service area S. At this time, the wiping apparatus 33 wipes the nozzle portion 21*a* of the print head, cleaning off the ink from the nozzle portion 21*a*. When the wiping finishes, the carriage 20 stops, and a cap 34 is positioned below the nozzle portion 21*a* and closes the nozzle portion 21*a*, thus preventing the ink from drying. A reference numeral 31 denotes a housing, 32 a slider, 35 a guide groove, 36 a guide protrusion, 37 a stopping part, and 38 a latching member.

Such a wiping apparatus 33 is for dry wiping and only wipes off ink by a physical frictional force between the wiping apparatus 33 and the nozzle portion 21*a* of the ink cartridge/printhead. However, since the print head is always dry due to certain characteristics of the print head and the surrounding environment, the ink residue is not completely wiped off with the dry wiping.

Accordingly, there has been a suggestion for a method of moving the wiping apparatus 33 to a separate apparatus (not shown) which is capable of providing moisture, wetting the wiping apparatus 33 by the separate apparatus, and then returning the wiping apparatus 33 back to the initial position, that is, to the wiping position prior to wiping the nozzle portion 21*a* of the print head. However, such a method requires a means for moving the wiping apparatus 33 and the separate apparatus for providing moisture, thus increasing the number of parts and manufacturing costs.

SUMMARY OF THE INVENTION

An aspect of the invention is to solve at least the above problems and/or disadvantages and to provide at least the advantages described hereinafter.

Accordingly, one aspect of the present invention is to solve the foregoing and/or other problems by providing a wet-type wiping apparatus of a simple structure which effectively wipes a nozzle portion of a print head, and a maintenance apparatus having the same.

To accomplish the above aspects and/or other features and advantages of the present invention, a wet-type wiping apparatus for an inkjet printer cleans a print head of the inkjet printer. The wet-type wiping apparatus includes a moisture storing portion, a moisture suction portion disposed on an upper side of the moisture storing portion and having a plurality of moisture suction holes, and a wiper portion inserted into the moisture storing portion and having a plurality of capillary tubes vertically penetrating therein.

The moisture storing portion may include a foam to contain moisture therein.

The moisture suction portion includes one of calcium chloride, a silica gel, and a high molecular substance, which are highly absorbent.

A maintenance apparatus for an inkjet printer includes a housing disposed in an inkjet printer body, a slider movably disposed on the housing, a wet-type wiping apparatus disposed on the slider, and a cap. Here, the wet-type wiping apparatus includes a moisture storing portion, a moisture suction portion disposed on an upper side of the moisture storing portion and having a plurality of moisture suction holes, and a wiper portion disposed to penetrate the moisture storing portion and having a plurality of capillary tubes vertically penetrating therein.

According to an embodiment of the present invention, the moisture storing portion includes a foam for containing moisture therein.

The moisture suction portion comprises one of calcium chloride, a silica gel, and a high molecular weight substance, which are highly absorbent.

According to the present invention described above, a wet-type wiping apparatus of simple structure is provided, and the wet-type wiping apparatus maintains moisture at the end of the wiper portion using a capillary phenomenon of the wiper portion so that a separate wiper moving unit is not required.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

The above and/or other aspects and features of the present invention will be more apparent by describing an embodiment of the present invention with reference to the accompanying drawings, in which.

DETAILED DESCRIPTION OF THE PREFERRED EMBODIMENTS

Figure 1:
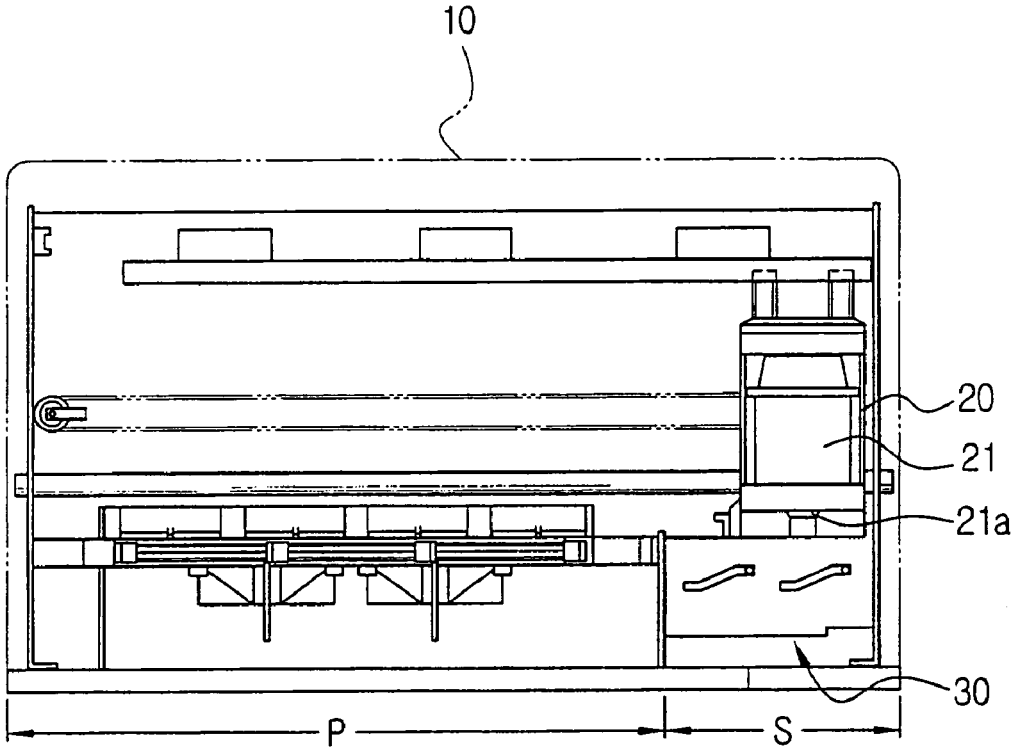
FIG. 1 (PRIOR ART)
FIG. 1 is a front view schematically showing the inside of a general inkjet printer.

Reference will now be made in detail to the present embodiments of the present invention, examples of which are illustrated in the accompanying drawings, wherein like reference numerals refer to the like elements throughout. The embodiments are described below to explain the present invention by referring to the figures.

Hereinafter, a wet-type wiping apparatus and a maintenance apparatus having the same according to an embodiment of the present invention will be described in greater detail with reference to the accompanying drawings.

Figure 3A:
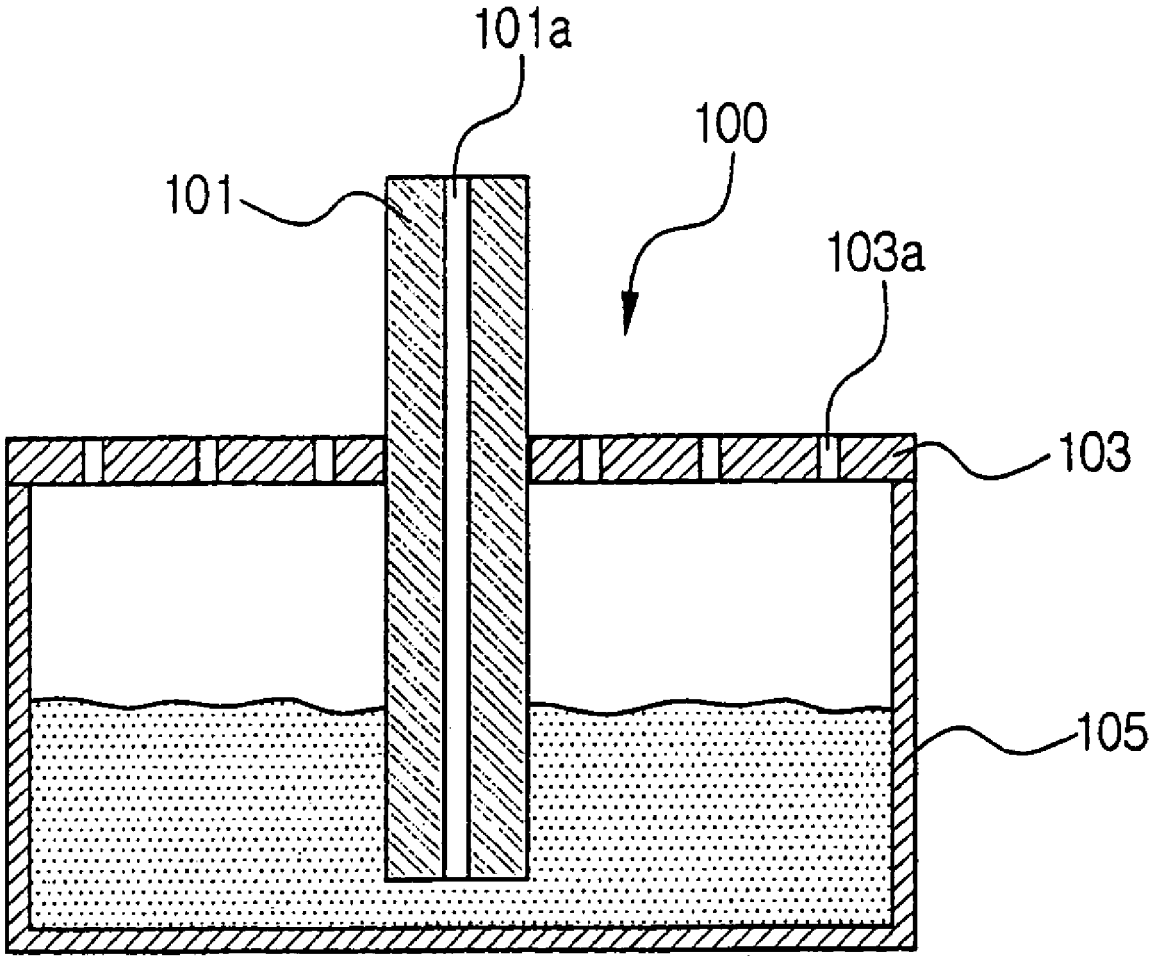
FIG. 3A is a sectional view schematically showing a wiping apparatus according to an embodiment of the present invention.
Figure 3B:
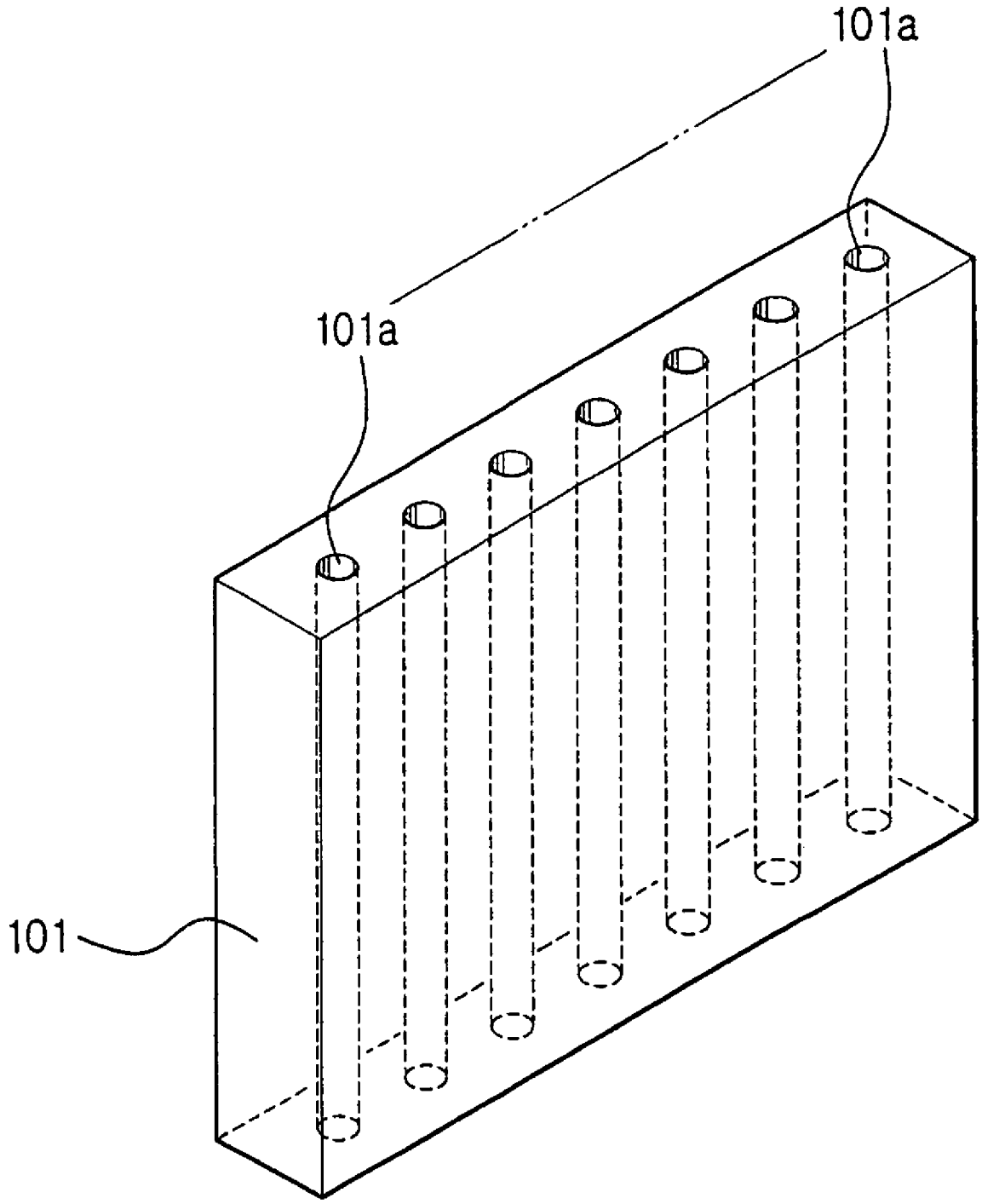
FIG. 3B is a perspective view schematically showing a wiper portion of the wiping apparatus of FIG. 3A.

FIG. 3A is a sectional view schematically showing a wiping apparatus for an inkjet printer according to an embodiment of the present invention, and FIG. 3B is a perspective view schematically showing a wiper portion of FIG. 3A.

The reference numeral 100 denotes a wiping apparatus, 101 a wiper portion, 101*a* a capillary tube, 103 a moisture suction portion, 103*a* a moisture suction hole and 105 a moisture storing portion.

The moisture suction portion 103 draws in moisture from the outside through a moisture suction hole 103*a* and stores the moisture in the moisture storing portion 105, which will be described later. According to an embodiment of the present invention, the moisture suction portion 103 is comprised of one of calcium chloride, a silica gel, and a high molecular weight substance which is highly absorbent, thus sucking in moisture from the outside.

The moisture storing portion 105 stores the moisture drawn in by the moisture suction portion 103 as described above. The moisture storing portion 105 has a predetermined shape, that is, typically a shape of a water tank, and stores the moisture in a liquid phase or is provided with foam which contains the moisture therein. Also, the liquid may be directly put into the moisture storing portion 105, as necessary.

The wiper portion 101 is inserted into the moisture suction portion 103 and has a plurality of capillary tubes 101*a* vertically penetrating through the wiper portion 101. The moisture stored in the moisture storing portion 105 is drawn up to the end of the wiper portion 101 along the capillary tubes 101*a* of the wiper portion 101 which penetrate the moisture suction portion 103 and utilize the capillary phenomenon.

According to an embodiment of the present invention, the wiper portion 101 is inserted at a predetermined distance from the bottom surface of the moisture storing portion 105, leaving a predetermined space to draw moisture continuously from the moisture storing portion 105.

By using the structure of the above-described wiping apparatus 100, the end of the wiper portion 101 is always moisturized, thus enabling an effective inkjet print head wiping with a simple structure.

Figure 2:
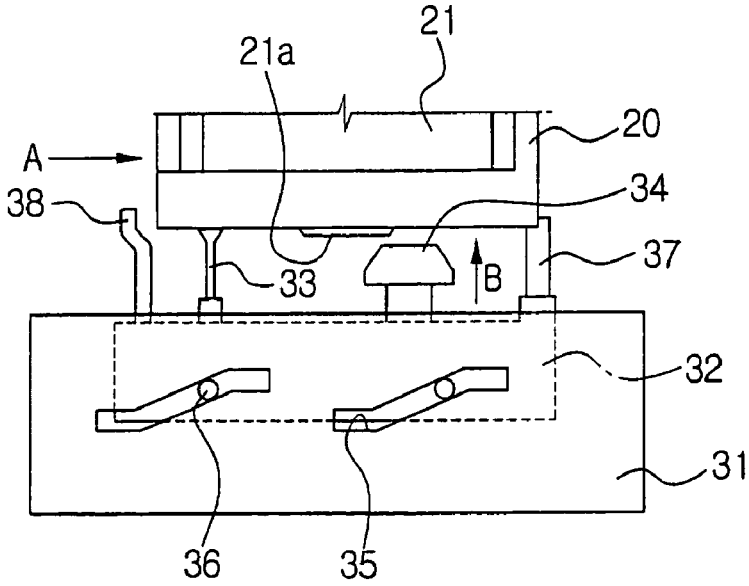
FIG. 2 (PRIOR ART)
FIG. 2 is a front view schematically showing a maintenance apparatus of a general inkjet printer.

Hereinafter, the operation of the wiping apparatus, according to an embodiment of the present invention will be described referring to FIGS. 2, 3A and 3B. For example, the wiping apparatus 100 of the present invention may replace the wiping apparatus 33 in FIG. 2. In such an embodiment, a desired image is formed by moving the carriage 20 left and right along the print area P (FIG. 1), while ejecting ink onto the paper sheet, and after the forming of the desired image is completed, the carriage 20 is moved to the service area S (FIG. 1) for wiping and capping.

At one side of the service area S, a maintenance apparatus is disposed. By one side of the carriage 20 moving to the service area S (FIG. 1), the guide protrusion 36 formed on the slider 32 of the maintenance apparatus moves along the guide groove 35 of the housing 31 and thus, the slider 32 moves.

The wiping apparatus 100 disposed on the slider 32 moves integrally with the slider 32, cleaning ink residue on the nozzle portion 21*a* which has finished printing. At this time, the moisture stored in the moisture storing portion 105 travels towards the end of the wiper portion 101 along the capillary tube 101*a* thereof, thus allowing wet-wiping of the nozzle portion 21*a* by the wiper portion 101 moisturized at all times.

After wet-wiping, and when the ink cartridge is parked, that is, when the carriage 20 is stopped by the stopping piece 37, the cap 34 closes the nozzle portion 21*a* to prevent ink on the nozzle from drying.

The foregoing embodiments and advantages are merely exemplary and are not to be construed as limiting the present invention. The present teaching may be readily applied to other types of apparatuses. The description of the present invention is intended to be illustrative, and not to limit the scope of the claims. Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wet-type wiping apparatus of an inkjet printer to clean a print head of the inkjet printer, the wet-type wiping apparatus comprising:

a moisture storing portion;

a moisture suction portion disposed on an upper side of the moisture storing portion and having a plurality of moisture suction holes; and a wiper portion penetrating in the moisture storing portion and having a plurality of capillary tubes vertically penetrating therein, wherein the moisture suction portion draws in moisture from outside through the plurality of moisture suction holes and stores the moisture in the moisture store portion.

2. The wet-type wiping apparatus of claim 1, wherein the moisture storing portion comprises a foam to contain moisture therein.

3. The wet-type wiping apparatus of claim 1, wherein the moisture suction portion comprises one of calcium chloride, a silica gel, and a high molecular weight absorbent substance.

4. A maintenance apparatus of an inkjet printer comprising:

a housing disposed in an inkjet printer body;

a slider movably disposed on the housing;

a wet-type wiping apparatus disposed on the slider; and a cap, wherein the wet-type wiping apparatus comprises, a moisture storing portion, a moisture suction portion disposed on an upper side of the moisture storing portion and having a plurality of moisture suction holes, and a wiper portion disposed to penetrate the moisture storing portion and having a plurality of capillary tubes vertically penetrating therein, wherein the moisture suction portion draws in moisture from outside through the plurality of moisture suction holes and stores the moisture in the moisture store portion.

5. The maintenance apparatus of claim 4, wherein the moisture storing portion comprises foam to contain moisture therein.

6. The maintenance apparatus of claim 4, wherein the moisture suction portion comprises one of calcium chloride, a silica gel, and a high molecular weight absorbent substance.

7. A wet-type wiping apparatus to clean a print head of an inkjet printer, the wet-type wiping apparatus comprising a wiper having moisture provided thereto by capillary action, wherein the moisture provided by capillary action is supplied from a unit comprising:

a moisture storing portion; and a moisture suction portion disposed on an upper side of the moisture storing portion and having a plurality of moisture suction holes, wherein the wiper is inserted into the moisture storing portion and has a plurality of capillary tubes vertically penetrating therein, wherein the moisture suction portion draws in moisture from outside through the plurality of moisture suction holes and stores the moisture in the moisture store portion.

8. The wet-type wiping apparatus of claim 7, wherein the moisture storing portion comprises a foam to contain moisture therein.

9. The wet-type wiping apparatus of claim 7, wherein the moisture suction portion comprises one of calcium chloride, a silica gel, and a high molecular weight absorbent substance.

10. The wet-type wiping apparatus of claim 7, wherein the wiper portion is inserted at a predetermined distance from the bottom surface of the moisture storing portion, leaving a predetermined space to draw moisture continuously from the moisture storing portion.

11. A wet-type wiping apparatus to clean a print head of an inkjet printer, the wet-type wiping apparatus comprising a wet wiper disposed on a slider, wherein the wet wiper comprises an outer portion and internal capillaries to allow moisture to be drawn from a storage unit by capillary action to an upper portion of the wet wiper, and wherein the storage unit comprises:

a moisture storing portion;

a moisture suction portion disposed on an upper side of the moisture storing portion and having a plurality of moisture suction holes, wherein the wet wiper is inserted into the moisture storing portion and has a plurality of capillary tubes vertically penetrating therein, wherein the moisture suction portion draws in moisture from outside through the plurality of moisture suction holes and stores the moisture in the moisture store portion.

12. The wet-type wiping apparatus of claim 11, wherein the moisture storing portion comprises a foam to contain moisture therein.

13. The wet-type wiping apparatus of claim 11, wherein the moisture suction portion comprises one of calcium chloride, a silica gel, and a high molecular weight absorbent substance.

14. A wet-wipe print head wiping inkjet printer apparatus, comprising:

a capillarity-based wet-wipe tube mounted in a moisture basin having a moisture-absorbent upper surfaces, wherein the moisture suction portion draws in moisture from outside through the plurality of moisture suction holes and stores the moisture in the moisture store portion.

* * * * *

UNITED STATES PATENT AND TRADEMARK OFFICE

CERTIFICATE OF CORRECTION

PATENT NO. : 7,090,328 B2
APPLICATION NO. : 10/682493
DATED : August 15, 2006
INVENTOR(S) : Kyung-chool Choi It is certified that error appears in the above-identified patent and that said Letters Patent is hereby corrected as shown below:

Col. 6, line 33, change “surfaces” to --surface--

Signed and Sealed this

Twenty-sixth Day of December, 2006

JON W. DUDAS
*Director of the United States Patent and Trademark Office*